United States Patent [19]

Liberg

[11] Patent Number: 4,715,309

[45] Date of Patent: Dec. 29, 1987

[54] DEVICE FOR THE HANDLING OF LIQUIDS

[75] Inventor: Lars-Olof Liberg, Kungälv, Sweden

[73] Assignee: Götaverken Arendal AB, Göteborg, Sweden

[21] Appl. No.: 814,770

[22] Filed: Dec. 30, 1985

[30] Foreign Application Priority Data

Jan. 21, 1985 [SE] Sweden ..... 8500263

[51] Int. Cl.[4] ..... B63B 43/06

[52] U.S. Cl. ..... 114/125; 114/74 R

[58] Field of Search ..... 114/125, 74 R, 121

[56] References Cited

U.S. PATENT DOCUMENTS

| | | | |
|---|---|---|---|
| 1,710,006 | 4/1929 | Peter | 114/74 R |
| 4,292,909 | 10/1981 | Conway | 114/74 R |
| 4,546,719 | 10/1985 | Collins et al. | 114/125 X |

FOREIGN PATENT DOCUMENTS

| | | | |
|---|---|---|---|
| 5183 | 1/1977 | Japan | 114/74 R |
| 123587 | 9/1980 | Japan | 114/74 R |
| 679484 | 8/1979 | U.S.S.R. | 114/74 R |
| 694414 | 10/1979 | U.S.S.R. . | |
| 1131754 | 12/1984 | U.S.S.R. | 114/74 R |

*Primary Examiner*—Jeffrey V. Nase
*Assistant Examiner*—Paul E. Salmon
*Attorney, Agent, or Firm*—Wegner & Bretschneider

[57] ABSTRACT

A ballast arrangement includes a number of tanks and a pump connected to a sea-chest and having a discharge conduit extending to a level above the top-most tank. A distribution conduit extends to the various tanks and an overflow pipe is connected to the discharge conduit and reaches to a further level, above the first mentioned level, where also an evacuation pipe is connected. The further level will determine the static pressure which may act in any of the associated tanks. The tanks may be connected to the suction side of the pump through by-pass conduits, and a two-way valve is designed so the pump can communicate only with either the sea-chest or with the by-pass conduits.

8 Claims, 4 Drawing Figures

DEVICE FOR THE HANDLING OF LIQUIDS

BACKGROUND OF THE INVENTION

The present invention refers to a device for the handling of liquids in stationary or floating working units of different kinds, in the first hand applicable to semi-submersible offshore vessels for drilling or production purposes, crane vessels, floating hotels and so forth, as well as for plants for similar purposes resting upon the bottom of the sea. The invention may also be used with floating docks and with cargo ships.

The invention disclosed herein will be described primarily with reference to ballast systems, to which it is generally applicable. However, in various vessels it will also be necessary to handle other liquids, such as drill water, sludge, fuel oil and so forth. This may include bunkering from outside, as well as transfer within the vessel.

STATE OF THE ART

Ballast tanks located below the operational water level can be flooded by opening a connection for free flow from the surrounding water, or by pumping. Ballast tanks located above water level must be filled by pumping.

When the filling occurs by free flow from the outside, there is a risk of uncontrolled inflow of water. When pumps are used, there is the risk that the tank will burst due to excessive water pressure, for instance due to under-dimensioned, or clogged evacuation pipes. The latter applies to all kind of tanks in the vessel.

For the sake of safety and efficiency it is desirable to use a ballast-pump having a high head of discharge (often 25% above the level encountered as a result of a damage). The pump must be openable also if the vessel is damaged, causing a listing or an increased draft.

In order to reduce water inflow through the evacuation pipes in a serious case of damage, the evacuation pipes from tanks ought to have a limited cross sectional area. A ballast tank which is adapted for filling by direct pumping of water must be dimensioned to withstand a certain internal pressure, above what corresponds to a fully filled evacuation pipe.

For the sake of stability the number of "free" water areas is limited, which means that the number of tanks which can be filled or emptied simultaneously is limited. The restricted areas of the evacuation pipes will determine the maximum conduit diameters in the conduity of the ballast systems. These circumstances may reduce the possibilities of fully utilizing the capacity of the pumps, or will reduce the dimensions of the pumps.

In certain installations, a large number of evacuation pipes will be needed especially with semi-submersible vessels, there are difficulties in providing the required space for these pipes, for instance the pipes from tanks in the pontoons.

OBJECTS OF THE INVENTION

One object of the present invention is to propose an arrangement for the handling of liquids in platform-vessels, and the like, which offers a possibility of reducing the hull weight by protecting the tanks from excessive internal pressure, while simultaneously allowing small-diameter evacuation pipes to be used.

A further object is to reduce the risk of unintentional inflow of water from the surrounding water to the tanks.

In order to reduce the risk of the tank bursting during filling by pumping it is sometimes required that the area of the evacuation pipe be at least 125% of the area of the distribution conduit. Such a pipe will require much space, resulting in excess weight. The invention provides a safe-guarding of the tanks against excessive pressure from the pumps, or other device causing the transportation of the liquid, and makes possible the utilization of a high pump capacity with moderate dimensions of the evacuation pipes. The suction conduits from the tanks may be big, which simplifies pumping operations, as fewer tanks may be emptied or filled simultaneously.

The invention ensures that the ballasting, or an internal transfer of ballast to a tank, can occur while utilizing full pumping capacity, until the tank is practically filled. Water may rise in the evacuation pipe to a level corresponding to the level of an overflow pipe. A continued pumping will only result in the surplus of water being dumped overboard by way of the overflow pipe.

A flow indicator in the latter, having a display unit in the control room for the ballast handling, will inform the ballast operator that the flow is now directed overboard, which means that the tank is filled.

During simultaneous filling of several tanks, excess water will pass through the overflow pipe only when all of the tanks have been filled.

In a conventional ballast system the filling of a tank must be carefully watched, so the supply is reduced before the tank is completely filled and water flows out over the deck through the overflow pipe. Otherwise the tank may be subjected to undue stresses. This means that the tanks, in practice, often are not fully filled.

SUMMARY OF THE INVENTION

According to the invention the conduitry includes an overflow pipe connected to a distribution conduit between the pump and the tank, the conduitry being so dimensioned, that the pressure in the point of connection for the overflow pipe, which, during normal operation is needed to cover the resistance to flow in the remaining portion of the conduit to the tank, is less than the pressure required to fill the overflow pipe to its highest level.

As long as the tank accepts the incoming water, nothing will flow out through the overflow pipe. When the tank is full, or if some hinderance occurs in the evacuation pipe or in the distribution conduit, the pressure at the point of attachment for the overflow pipe will rise, whereby the flow, partly or fully, will be directed overboard by way of the overflow pipe.

This is preferably devoid of shut-off means, and is supposedly dimensioned so the resistance to flow therein is neglectable, or in any case low, also during maximum flow.

With this device the tank can never be subjected to a higher static pressure from the pump than corresponds to the difference between the level of the tank and the higher point of the overflow pipe.

In a water-borne vessel, where the pump is directly connectable to a sea-chest, a discharge portion of the distribution conduit from the pump is led to a level higher than the tank, and the point of attachment for the overflow pipe is located at this high level.

Preferably an evacuation pipe or corresponding, siphon-action interrupting device is connected to the conduit at the said high level.

The distribution conduit preferably includes a shut-off valve, which, when closed, permits fluid to be dumped by way of the overflow pipe. Also, the discharge portion may include a shut-off valve, the closing of this valve simultaneously with the valve in the supply conduit isolating the overflow pipe from the remainder of the conduitry.

The discharge portion preferably reaches to the raised level and this or the highest level of the overflow pipe is then located above the level of the maximum water level surrounding the vessel.

For de-ballasting of a system including a number of tanks, at least one by-pass conduit is connected to the suction side of the pump, the valve means thereat offering a selective connection either to a sea-chest, or to the by-pass conduit. These valve means may include a two-way valve, or separate valves at the sea-chest and in the by-pass conduit, respectively, said valves being interlocked so only one of them can be open at a time.

In order to make possible an internal transfer of ballast water in a system comprising a number of tanks at different levels and/or at different distances horizontally from each other by means of the ballast pump without the risk of locally increased water pressure, branches of the distribution conduit to the individual tanks are each provided with shut-off valves, there being at least two by-pass conduits, each having a shut-off valve.

When handling contaminated fluids such as fuel oil, sludge or the like, a pump in the conduitry is preferably provided with an inwardly closing non-return valve at its pressure side, the overflow conduit being connected to a by-pass conduit at the pump and includes a shut-off valve upstream of the point of connection for the overflow pipe, the latter being provided with a liquid-level guard governing the shut-off valve.

A further valve is preferably located in the by-pass conduit downstream of the point of attachment of the overflow pipe, and is interlocked with the valve upstream of said point of attachment.

DETAILED DESCRIPTION

Figure 1:
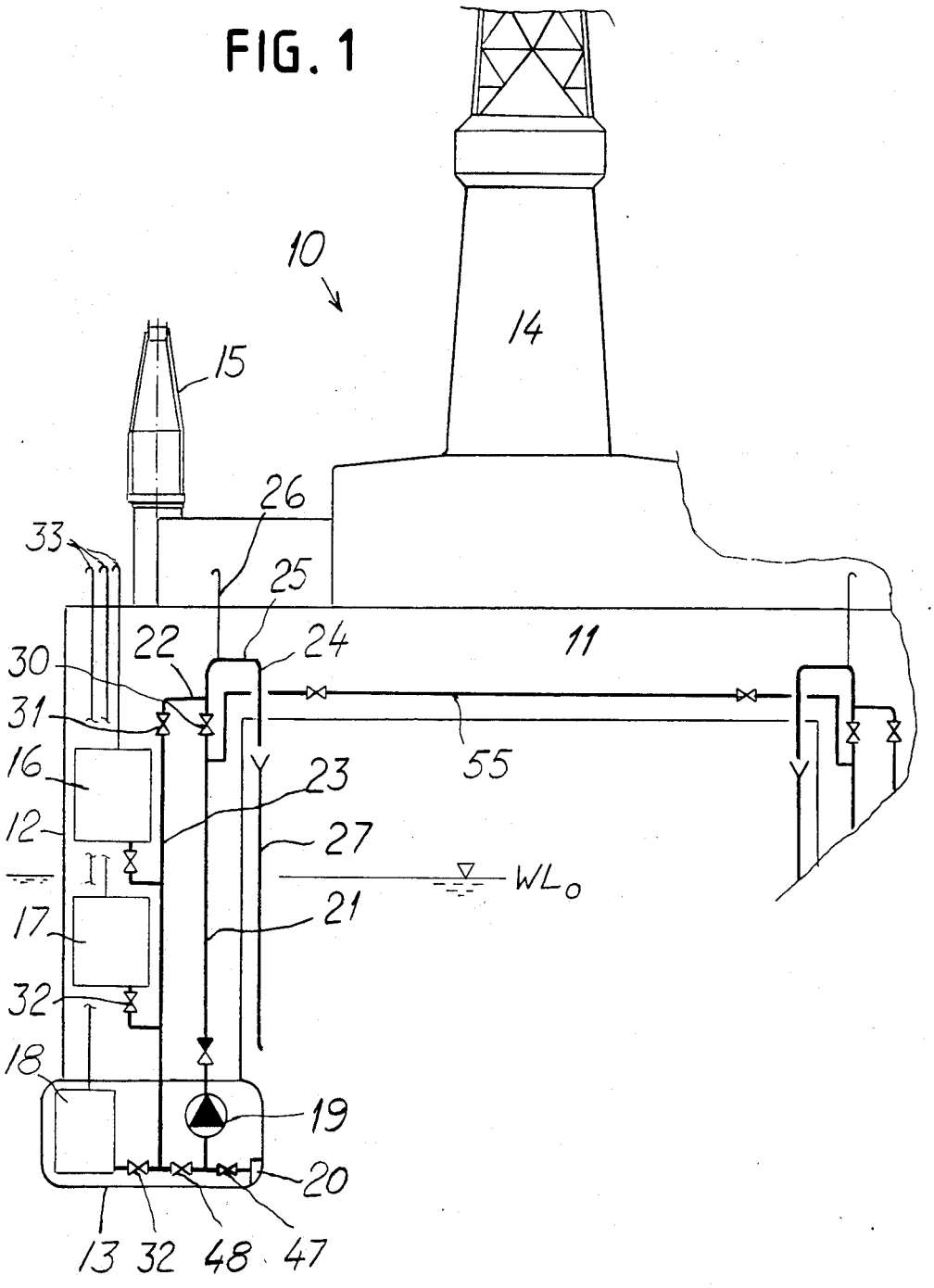
FIG. 1 shows a front view of a portion of a semi-submersible offshore vessel in which part of the ballast system is schematically denoted.

FIG. 1 shows a portion of a semi-submersible offshore vessel 10, and indicates part of the ballast system therein. The vessel has an operating deck 11, which is carried by a number of columns 12, resting upon two submerged pontoons 13 only one being shown in FIG. 1. Mounted upon the operating deck is a drill derrick 14, as well as housing for the staff, stores and workshops. The vessel is provided with a number of cranes 15 for handling cargo and equipment.

The operational waterlevel Wlo normally reaches about halfway up the columns 12, but when the vessel is under way, part of the ballast system is emptied, so the waterline during transit will be located about level with the decks of the pontoons 13.

In order to make possible such a change in the draft, for compensating varying distribution of the load within the vessel, and for counteracting the moments of force caused by the cranes 15 upon the vessel when handling cargo, a complex ballast arrangement is required. This must be operable even if the vessel, for instance due to a collision damage, should suffer a noticable list.

For safety purposes a number of systems operating in parallel are provided, and may be interconnected. It is desirable to locate ballast tanks at different levels within the vessel, and also to arrange a distribution of the tanks horizontally, especially in the pontoons.

In FIG. 1 references 16 and 17 indicate tanks at different levels within a column, while 18 denotes a tank in a pontoon 13. Each reference numeral may represent a number of tanks, which will be evident from FIG. 2.

A pump 19 is connectable to a sea-chest 20, and supplies ballast water through a discharge conduit 21, which extends to a level 22, above the uppermost tank 16. From this level a distribution conduit 23 extends to the actual tanks 16, 17, 18, water therein flowing due to gravity.

An overflow pipe 24 is connected to the point where the distribution conduit 23 is branched off from the discharge conduit, and extends with a reversed U-shaped bent portion to a level 25, raised above level 22. An evacuation pipe 26 extends from the U-bend to above the deck. The overflow pipe 24 opens at the outside of the column, adjacent to the transition thereof into the deck structure, and is continued by an external drain pipe 27.

It is important that pipe 24 is short and offers a low resistance to flow. The level 25 shall be located below the level to which evacuation pipes from the tanks extend.

The overflow pipe is here connected to the point where the discharge conduit is branched off. On other occasions it may be desirable to connect the overflow pipe further down the discharge conduit, and it will then be necessary to arrange so the pressure at the point of attachment does not exceed what is necessary, during normal operation, to cover the resistance to flow in the remaining part of the flow path.

Level 25 will determine the highest static pressure acting in either of tanks 16, 17, 18, and due to the arrangement shown the pump pressure will not act upon the tanks. The evacuation pipe 26 will interrupt any siphon action, which means that no flow in to, or out of, the tanks will occur if the pump stops. The level 22 and the overboard terminal at pipe 24 are located above the waterline (Wld), which may be expected after a serious damage to the vessel, and above the ballast tanks. This means that water can not flow in through, or out through the sea-chest 20, or the overflow pipe 24, even if some valve, for one reason or the other, should have been left open. Hereby the safety margin is raised considerably, compared with conventional ballast systems, where an unintended flow between the sea-chest and the overboard connection may result in a dangerous list of the vessel, in a serious case resulting in the latter capsizing.

Figure 2:
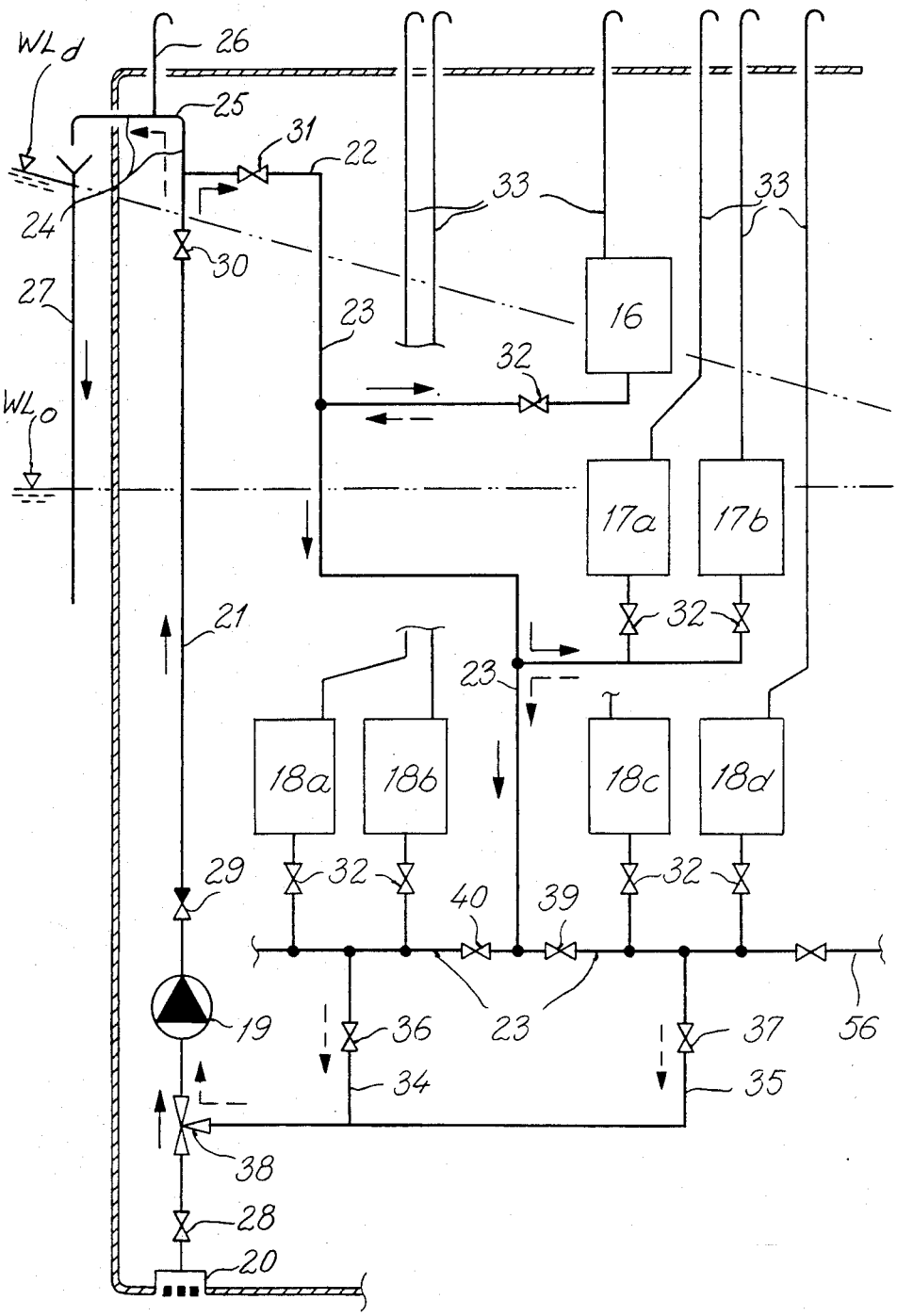
FIG. 2 shows a basic lay-out for the conduitry between a pump and a number of tanks.

FIG. 2 is a schematic lay-out showing a ballast system of the kind indicated in FIG. 1. In a vessel of this type large volumes and long conduits are involved. For the sake of safety, and to facilitate repair and overhaul, shut-off valves should be provided in many places in the system, for instance 28 between the pump 19 and the sea-chest 20, as well as 29, 30 in the discharge pipe 21, and 31, 39, 40 in the supply conduit 23, and others. Valve 30 is preferably a throttle valve, adapted to govern the flow of ballast water. Each ballast tank 16, 17, 18 is provided with a shut-off valve 32, where the distribution conduit 23 enters, and has an evacuation pipe 33, extending above the deck.

The overflow pipe 24 does not have any shut-off means, and is dimensioned so small resistance to flow occurs, even during maximum flow.

During de-ballasting of the tanks the water is pumped upwards through the discharge conduit. The valve 31 is closed so the flow is directed overboard.

In order to compensate changes in trim and list, it may be necessary to transfer ballast water between tanks separated vertically or horizontally.

There are two by-pass conduits 34, 35, each having a shut-off valve 36, 37, between the distribution conduit 23 and the inlet to the pump 19. When the tanks are to be emptied the water is dumped overboard by way of pipe 27.

In the connection between the pump 19 and the sea-chest 20, there is a two-way valve 38, which is designed so the pump can only communicate with the sea-chest 20, or with any of the by-pass conduits 34, 35, but also so none of the latter may communicate with the sea-chest. Water cannot thus flow from outside the vessel directly to any tank, but must be pumped past level 22. This provides a high degree of safety concerning undesired waterflows.

In FIG. 2, Wld indicates the waterline which may be expected at a heavy list due to some damage to the vessel.

According to the invention no tank will be subjected to pressure exceeding that corresponding to the static pressure from level 25. The evacuation pipes from the tank may thus be dimensioned solely with respect to air flow, and can be designed with considerably smaller cross-sectional area than with conventional systems, where the evacuation pipes must be dimensioned with respect to dynamic losses during an overfilling of the tanks. As the bulkheads defining the individual tanks will not be subjected to the over-pressures, which may be expected during direct pumping to a tank due to resistance to flow during a possible over-filling of the tank, or due to a clogged evacuation pipe, the weight of the steel structure can be considerably reduced.

Figure 3:
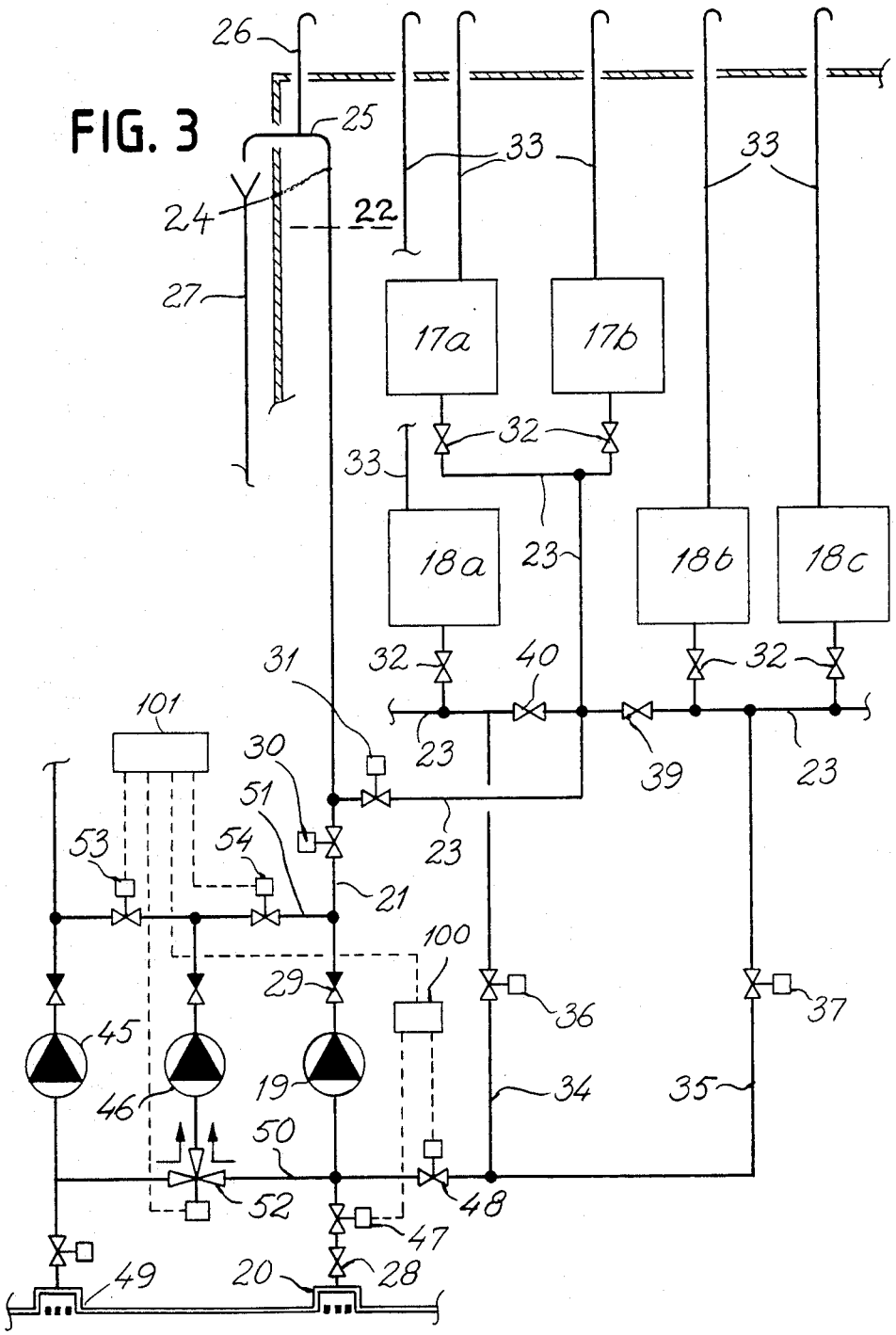
FIG. 3 shows how the ballast system may be coordinated with a further pump in the vessel, and FIG. 4 schematically shows an arrangement for handling contaminating liquids.

FIG. 3 shows a modified embodiment of a ballast arrangement, and the same reference numerals as in FIG. 2 are used, whenever applicable.

The distribution conduit 23 is branched off from the discharge conduit 21 from the pump at a low level, but the overflow pipe 24 continues the discharge conduit and reaches to level 25.

Instead of the two-way valve 38 there is a valve 47 in the connection to the sea-chest and a valve 48 downstream of the by-pass conduits 34, 35. The valves 47 and 48 are interconnected by mechanical, hydraulic or electric means, so only one of them can be open at a time. FIG. 3 further shows how the ballast pump 19 may be combined with a cooling water pump 45 and a reserve pump 46.

The cooling water pump 45 is connected to a further seachest 49, and the reserve pump 46 is dimensioned so it can serve either as ballast pump or as cooling water pump.

By-pass conduits 50 and 51 are connected at the suction and the pressure side of the ballast pump. There is a two-way valve 52 in the first conduit and shut-off valves 53, 54 in the other conduit. The valves 52, 53 and 54 are in any suitable manner connected with valve 47 at the sea-chest of the ballast pump 19, so the first mentioned valves are operable in connection with the ballast system only when valve 47 is closed.

Governing means for the interlocking arrangement at valves 47 and 48 is denoted by 100, and the governing means between said valves and valves 52, 53, 54 is denoted by 101.

All valves are preferably of the remotely-controlled type. A ballast arrangement of the type shown is located in each of the columns and the adjacent parts of the pontoons of the vessel. The arrangements in the various columns are preferably interconnected longitudinally as well as transversely by cross-over conduits, in FIG. 1 denoted by 55 and in FIG. 2 by 56.

The discharge conduit 21 and the distribution conduit 23 may at level 22 be connected by way of a receptacle having an effluent 25 and an evacuation conduit 26.

Figure 4:
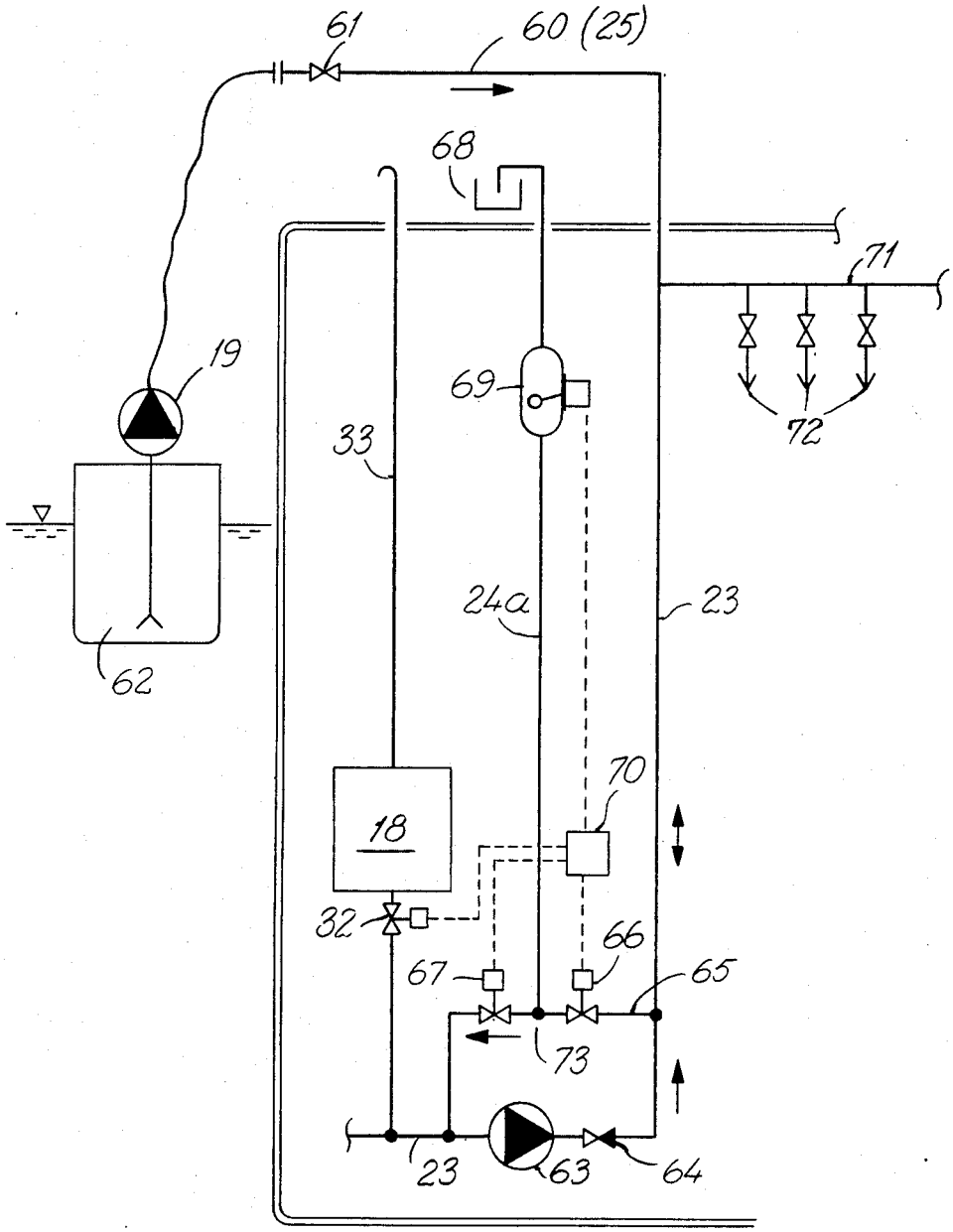

FIG. 4 shows an arrangement according to the invention suited for the handling of fuel oil or other fluid which may contaminate the environments, or where it for some reason is not desirable to permit a free flow overboard.

One or more fuel oil tanks are, as before, denoted by 18 and the evacuation pipe is denoted by 33.

A bunkering conduit 60 upon the deck of the vessel represents the raised level 22, and is provided with an attachment valve 61 at the point and the starboard side of the vessel.

A supply vessel 62 delivers fuel oil and is provided with a pump 19. From the bunkering conduit 60 the oil will flow by gravity through the distribution conduit 23 to the tank 18.

As mentioned before there are a number of tanks, each provided with a shut-off valve 32. For transferring oil within the vessel there is a further pump 63, which is provided with an inwardly closing non-return valve 64 at its discharge side. A by-pass conduit 65 connects two portions of the distribution conduit 23 located to opposite sides of pump 63.

The overflow conduit **24*a* is connected to the by-pass conduit 65 at a point 73 between two valves 66 and 67 in the by-pass conduit, and extends substantially to the level of the bunkering conduit 60. A receptacle 68 takes care of oil being possibly expelled through conduit 24*a***.

The conduitry shall be so dimensioned, that the pressure at the point of connection 73 does not exceed what is needed to surmount the resistance to flow in the remaining part of conduit 23. In such manner there is normally no tendency for the oil to rise in pipe **24*a***.

In the latter there is a liquid level guard 69, which reacts should the oil reach the upper part of pipe **24*a*. The level guard governs valve 66** so this will close when the oil reaches the guard.

The non-return valve 64 prevents flow backwards through pump 63, and the normal flow path during bunkering is this through by-pass conduit 65.

Valve 67 is needed in order that pump 63 shall not suck in air by way of pipe **24*a* during internal transfer of oil. This valve must however be opened before valve 66 can be opened and can not be closed as long as last mentioned valve remains open. This is indicated by a simple interlocking arrangement denoted 70**.

Valve 67 shall furthermore be governed so it can not be opened until a valve 32 at at least one tank is open.

Pump 63 is used for the internal transfer of oil in the vessel to daytanks at different oil consumers, as well as for transfer between port and starboard tanks 18.

A distribution conduit 71 is connected to the upper part of the vertical portion of conduit 23, and is by branch conduits 72 connected to various consumers.

A corresponding arrangement is provided at the opposite pontoon of the vessel and the two arrangements are interconnected by way of the bunkering conduit 60 or by way of the distribution conduit 71. Pump 63 may thus be used for transferring oil from one tank 18 (starboard) to one tank 18 (port) by either of these conduits.

Irrespective of the kind of liquid stored in the various tanks it is desirable that the tanks must not be dimensioned for a high pump pressure. With ballast systems directly connected to sea-chest it is furthermore important that means are provided to interrupt any siphon action, which aids in preventing undesired inflow of water in case of a damage to the vessel.

I claim:

1. A ballast handling system for a seaborne vessel, comprising a pump connected to at least one tank by conduitry comprising:

(A) means for connecting the suction side of the pump with the water surrounding the vessel;

(B) a riser conduit connected to the pressure side of said pump which extends to a first level above said tanks;

(C) a distribution conduit branched off from the riser conduit at said first level which leads to said at least one tank;

(D) an overflow pipe extending to a second level above the first level and having an outboard terminal above the maximum possible water level surrounding the vessel after serious damage to the vessel; and (E) a first shut-off valve in said riser conduit and a second shut-ff valve in said distribution conduit which isolate, when closed, the overflow pipe from the remainder of the conduitry;

(F) wherein the conduitry is dimensioned so that the pressure required to raise liquid to said first level substantially corresponds to the pressure required, in normal use, to cover losses of flow in the distribution conduit.

2. A ballast handling system as claimed in claim 1, wherein each of said at least one tank has an air evacuation pipe extending to a third level above said second level.

3. A ballast handling system as claimed in claim 1, wherein said distribution conduit is connected to a plurality of tanks, and wherein said conduitry further comprises at least one by-pass conduit connecting the distribution conduit to the suction side of the pump, and valve means thereat which selectively connects the pump either to the by-pass conduit or to the means for connecting.

4. A ballast handling system as claimed in claim 1, wherein said distribution conduit is connected to a plurality of tanks, and wherein said conduitry further comprises at least one by-pass conduit connecting the distribution conduit to the suction side of the pump, and a two-way valve thereat which selectively connects the pump either to the by-pass conduit or to the means for connecting.

5. A ballast handling system as claimed in claim 1, wherein said distribution conduit is connected to a plurality of tanks, and wherein said conduitry further comprises at least one by-pass conduit connecting the distribution conduit to the suction side of the pump, and value means including separate shut-off valves in said by-pass conduit and said means for connecting, said shut-off valves being interlocked so that only one can be open at a time.

6. A ballast handling system as claimed in claim 1, further comprising an air evacuation pipe connected to the overflow pipe at said second level and extending to a third level.

7. A ballast handling system as claimed in claim 1, wherein said overflow pipe is devoid of shut-off means.

8. A ballast handling system for a seaborne vessel, comprising a pump connected to tanks located at different levels and different horizontal distances from each other by conduitry, said conduitry comprising:

(A) means for connecting the suction side of the pump, with the water surrounding the vessel;

(B) a riser conduit connected to the pressure side of said pump which extends to a first level above said tanks;

(C) a distribution conduit branched off from the riser conduit at said first level, and branches which lead from said distribution conduit to said tanks;

(D) an overflow pipe extending to a second level above the first level and having an outboard terminal above the maximum possible water level surrounding the vessel; and (E) a first shut-off valve in said riser conduit and a second shut-off valve in said distribution conduit which isolate, when closed, the overflow pipe from the remainder of the conduitry;

(F) wherein each of the branches has a shut-off valve, and said conduitry further comprises at least two parallel by-pass conduits between said distribution conduit and the suction side of the pump, each of said by-pass conduits having a shut-off valve, and wherein the conduitry is dimensioned so that the pressure required to raise liquid to said first level substantially corresponds to the pressure required, in normal use, to cover losses of flow in the distribution conduit.

* * * * *